US008645140B2

(12) United States Patent
Lobzakov

(10) Patent No.: US 8,645,140 B2
(45) Date of Patent: Feb. 4, 2014

(54) ELECTRONIC DEVICE AND METHOD OF ASSOCIATING A VOICE FONT WITH A CONTACT FOR TEXT-TO-SPEECH CONVERSION AT THE ELECTRONIC DEVICE

(75) Inventor: Yuriy Lobzakov, Redwood City, CA (US)

(73) Assignee: BlackBerry Limited, Waterloo, Ontario (CA)

( * ) Notice: Subject to any disclaimer, the term of this patent is extended or adjusted under 35 U.S.C. 154(b) by 474 days.

(21) Appl. No.: 12/392,357

(22) Filed: Feb. 25, 2009

(65) Prior Publication Data

US 2010/0217600 A1 Aug. 26, 2010

(51) Int. Cl.
*G10L 13/08* (2013.01)

(52) U.S. Cl.
USPC ..... 704/260; 704/258; 704/268; 704/270.1; 704/275; 704/270; 379/142.17; 379/207.02; 379/374.02; 379/88.01; 379/88.16; 379/88.18; 455/412.2

(58) Field of Classification Search
USPC ..... 704/10, 243, 258, 260, 266, 270
See application file for complete search history.

(56) References Cited

U.S. PATENT DOCUMENTS

| | | | | |
|---|---|---|---|---|
| 5,278,943 | A * | 1/1994 | Gasper et al. | 704/200 |
| 5,933,805 | A * | 8/1999 | Boss et al. | 704/249 |
| 5,946,654 | A * | 8/1999 | Newman et al. | 704/246 |
| 6,275,806 | B1 * | 8/2001 | Pertrushin | 704/272 |
| 6,278,968 | B1 * | 8/2001 | Franz et al. | 704/3 |
| 6,289,085 | B1 | 9/2001 | Miyashita et al. | |
| 6,553,341 | B1 | 4/2003 | Mullaly | |
| 6,681,208 | B2 * | 1/2004 | Wu et al. | 704/260 |
| 6,748,075 | B2 * | 6/2004 | Ojiro | 379/374.02 |
| 6,789,066 | B2 * | 9/2004 | Junkins et al. | 704/500 |
| 6,801,931 | B1 * | 10/2004 | Ramesh et al. | 709/206 |
| 6,839,669 | B1 * | 1/2005 | Gould et al. | 704/246 |
| 7,483,832 | B2 * | 1/2009 | Tischer | 704/260 |
| 7,590,539 | B1 * | 9/2009 | Kirkpatrick | 704/260 |
| 7,693,719 | B2 * | 4/2010 | Chu et al. | 704/270.1 |
| 7,933,396 | B2 * | 4/2011 | Chin et al. | 379/207.02 |
| 8,024,193 | B2 * | 9/2011 | Bellegarda | 704/269 |
| 8,131,549 | B2 * | 3/2012 | Teegan et al. | 704/260 |
| 8,406,389 | B2 * | 3/2013 | Mousseau et al. | 379/88.18 |

(Continued)

FOREIGN PATENT DOCUMENTS

WO 2004047466 A2 6/2004

OTHER PUBLICATIONS

Verma, A., et al: "Voice Fonts for Individuality Representation and Transformation", ACM Transactions on Speech and Language Processing (TSLP vol. 2, 4, Feb. 28, 2005, XP002538954 New York, USA DOI: http://doi.acm.org/10.1145/1075389.1075393 Retrieved from the Internet: URL: http://portal.acm.org/citation.cfm?id=1075389.1075393.

(Continued)

*Primary Examiner* — Pierre-Louis Desir
*Assistant Examiner* — Fariba Sirjani
(74) *Attorney, Agent, or Firm* — Fish & Richardson P.C.

(57) ABSTRACT

A method of associating a voice font with a contact for text-to-speech conversion at an electronic device includes obtaining, at the electronic device, the voice font for the contact, and storing the voice font in association with a contact data record stored in a contacts database at the electronic device. The contact data record includes contact data for the contact.

10 Claims, 11 Drawing Sheets

(56) References Cited

U.S. PATENT DOCUMENTS

| | | | | |
|---|---|---|---|---|
| 2003/0018473 | A1* | 1/2003 | Ohnishi et al. | 704/258 |
| 2003/0028380 | A1* | 2/2003 | Freeland et al. | 704/260 |
| 2003/0061041 | A1* | 3/2003 | Junkins et al. | 704/254 |
| 2003/0078780 | A1* | 4/2003 | Kochanski et al. | 704/258 |
| 2004/0098266 | A1* | 5/2004 | Hughes et al. | 704/277 |
| 2004/0111271 | A1* | 6/2004 | Tischer | 704/277 |
| 2004/0184591 | A1* | 9/2004 | Shimomura et al. | 379/142.17 |
| 2004/0193421 | A1* | 9/2004 | Blass | 704/258 |
| 2005/0096909 | A1* | 5/2005 | Bakis et al. | 704/260 |
| 2005/0108013 | A1* | 5/2005 | Karns | 704/254 |
| 2005/0180547 | A1* | 8/2005 | Pascovici | 379/88.01 |
| 2005/0222846 | A1* | 10/2005 | Tomes | 704/275 |
| 2006/0069567 | A1* | 3/2006 | Tischer et al. | 704/260 |
| 2006/0074672 | A1* | 4/2006 | Allefs | 704/258 |
| 2006/0095265 | A1* | 5/2006 | Chu et al. | 704/268 |
| 2006/0149558 | A1* | 7/2006 | Kahn et al. | 704/278 |
| 2006/0193451 | A1* | 8/2006 | Sharma | 379/88.16 |
| 2007/0174396 | A1* | 7/2007 | Kumar et al. | 709/206 |
| 2008/0171536 | A1* | 7/2008 | Katz | 455/412.2 |
| 2008/0235024 | A1* | 9/2008 | Goldberg et al. | 704/260 |
| 2008/0291325 | A1* | 11/2008 | Teegan et al. | 348/552 |
| 2009/0063152 | A1* | 3/2009 | Munakata | 704/260 |
| 2009/0070113 | A1* | 3/2009 | Gupta et al. | 704/257 |
| 2009/0089063 | A1* | 4/2009 | Meng et al. | 704/270 |
| 2009/0125309 | A1* | 5/2009 | Tischer | 704/260 |
| 2009/0135177 | A1* | 5/2009 | Strietzel et al. | 345/419 |
| 2009/0177473 | A1* | 7/2009 | Aaron et al. | 704/260 |
| 2010/0057435 | A1* | 3/2010 | Kent et al. | 704/3 |
| 2010/0088097 | A1* | 4/2010 | Tian et al. | 704/251 |
| 2010/0153116 | A1* | 6/2010 | Szalai et al. | 704/260 |
| 2010/0198577 | A1* | 8/2010 | Chen et al. | 704/2 |
| 2010/0215177 | A1* | 8/2010 | Lobzakov et al. | 380/274 |
| 2010/0220609 | A1* | 9/2010 | Lobzakov et al. | 370/252 |
| 2010/0312563 | A1* | 12/2010 | Zhao et al. | 704/260 |
| 2011/0124264 | A1* | 5/2011 | Garbos | 446/147 |
| 2011/0144980 | A1* | 6/2011 | Rysenga | 704/201 |
| 2011/0153620 | A1* | 6/2011 | Coifman | 707/748 |
| 2011/0212714 | A1* | 9/2011 | Lobzakov et al. | 455/416 |
| 2011/0314381 | A1* | 12/2011 | Fuller et al. | 715/727 |
| 2012/0083250 | A1* | 4/2012 | George et al. | 455/414.1 |
| 2012/0136661 | A1* | 5/2012 | Fu et al. | 704/254 |

OTHER PUBLICATIONS

Extended European Search Report for European Patent Application No. 09153554.2-1224 dated Aug. 5, 2009.

"Speech Software Speaks Email on Windows Mobile Devices", WindowsForDevices.com, Feb. 25, 2005.

Communication Pursuant to Article 94(3) EPC issued in European Application No. 09153554.2 on Mar. 14, 2011; 4 pages.

Office Action issued in Canadian Application No. 2,694,530 on Jul. 5, 2012; 3 pages.

Communication under Rule 71(3) EPC issued in European Application No. 09153554.2 on Oct. 17, 2012; 53 pages.

* cited by examiner

ELECTRONIC DEVICE AND METHOD OF ASSOCIATING A VOICE FONT WITH A CONTACT FOR TEXT-TO-SPEECH CONVERSION AT THE ELECTRONIC DEVICE

TECHNICAL FIELD

The present application relates to electronic devices with communication capabilities such as electronic messaging and telephonic capabilities, and to the identification of the originator of such communications.

BACKGROUND DISCUSSION

Electronic devices, including portable electronic devices, have gained widespread use and can provide a variety of functions including, for example, telephonic, electronic messaging and other personal information manager (PIM) application functions. Portable electronic devices can include several types of devices for communication including mobile stations such as simple cellular telephones, smart telephones and wireless PDAs. These devices run on a wide variety of networks from data-only networks such as Mobitex and DataTAC to complex voice and data networks such as GSM/GPRS, CDMA, EDGE, UMTS and CDMA2000 networks.

Upon receipt of a communication, such as a telephone call or an electronic message, output is commonly provided from the electronic device in the form of a notification of receipt of the communication or in the form of text on a display. For example, upon receipt of a telephone call, an audible notification such as a ring tone may be provided along with visual notification on the display such as a caller identification. Similarly, upon receipt of an email message, for example, audible and visual notifications may be received. Further, text of the email is displayed in response to opening the email message.

In many instances, an audible output is preferable to a text output, for example, for providing output for a person engaged in driving a vehicle or for providing output to a visually impaired person. In such instances, reading a display screen on a portable electronic device may be very difficult or even dangerous. Thus, the audible output from a speaker is preferred to visual output from a display device. Unfortunately, less information is provided via an audible output as, for example, notifications in the form of, for example, ring tones can be provided while other information such as caller identification, email originator identification or text content of an email is not provided. While text can be provided by, for example an audible file such as a .wav file, using text-to-speech conversion, the addition of such an audible file to the transmitted text significantly increases transmitted data resulting in greater required bandwidth and increased transmission time and cost for the user of the portable electronic device. Further, conversion of text does not provide information such as the identification of a caller or an email originator, for example.

Improvements in audible output of notifications and text are therefore desired.

BRIEF DESCRIPTION OF THE DRAWINGS

Embodiments of the present application will now be described, by way of example only, with reference to the attached Figures, wherein:

FIG. 4 is a block diagram illustrating components of an exemplary configuration of a host system that the portable electronic device can communicate with;

DETAILED DESCRIPTION

Figure 1:
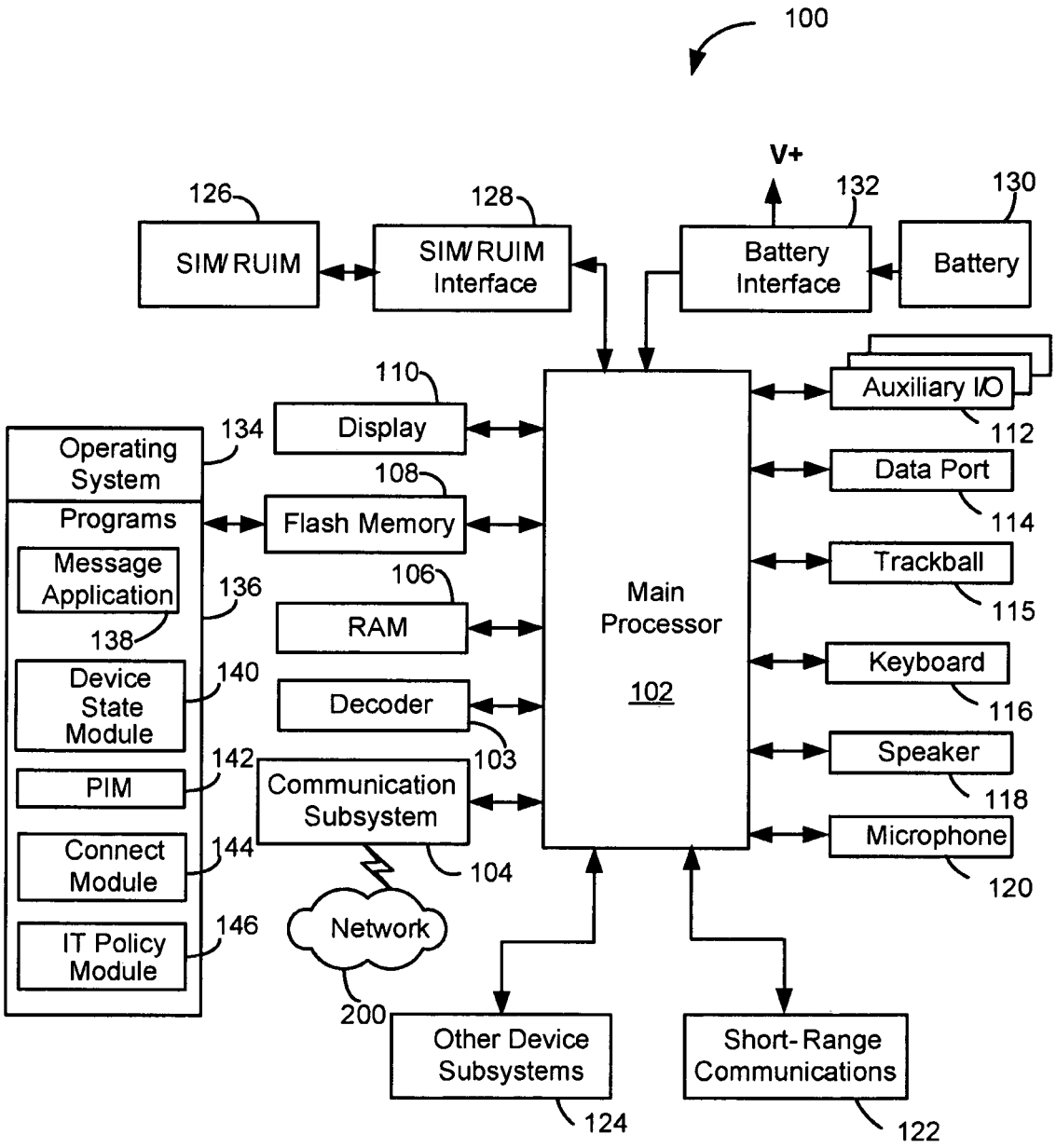
FIG. 1 is a block diagram of an exemplary embodiment of a portable electronic device.

It will be appreciated that for simplicity and clarity of illustration, where considered appropriate, reference numerals may be repeated among the figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, well-known methods, procedures and components have not been described in detail so as not to obscure the embodiments described herein. Also, the description is not to be considered as limiting the scope of the embodiments described herein.

The embodiments described herein generally relate to portable electronic devices. Examples of portable electronic devices include mobile or handheld wireless communication devices such as pagers, cellular phones, cellular smartphones, wireless organizers, personal digital assistants, computers, laptops, handheld wireless communication devices, wirelessly enabled notebook computers and the like.

The portable electronic device may be a two-way communication device with advanced data communication capabilities including the capability to communicate with other portable electronic devices or computer systems through a network of transceiver stations. The portable electronic device may also have the capability to allow voice communication. Depending on the functionality provided by the portable electronic device, it may be referred to as a data messaging device, a two-way pager, a cellular telephone with data messaging capabilities, a wireless Internet appliance, or a data communication device (with or without telephony capabilities). To aid the reader in understanding the structure of the portable electronic device and how it communicates with other devices and host systems, reference will now be made to FIGS. 1 through 4.

Referring first to FIG. 1, shown therein is a block diagram of an exemplary embodiment of a portable electronic device 100. The portable electronic device 100 includes a number of components such as a main processor 102 that controls the overall operation of the portable electronic device 100. Communication functions, including data and voice communications, are performed through a communication subsystem 104. Data received by the portable electronic device 100 can be decompressed and decrypted by a decoder 103, operating according to any suitable decompression techniques (e.g. YK decompression, and other known techniques) and encryption techniques (e.g. using an encryption technique such as Data Encryption Standard (DES), Triple DES, or Advanced Encryption Standard (AES)). The communication subsystem 104 receives messages from and sends messages to a wireless network 200. In this exemplary embodiment of the portable electronic device 100, the communication subsystem 104 is configured in accordance with the Global System for Mobile Communication (GSM) and General Packet Radio Services (GPRS) standards. The GSM/GPRS wireless network is used worldwide and it is expected that these standards will be superseded eventually by Enhanced Data GSM Environment (EDGE) and Universal Mobile Telecommunications Service (UMTS). New standards are still being defined, but it is believed that they will have similarities to the network behavior described herein, and it will also be understood by persons skilled in the art that the embodiments described herein are intended to use any other suitable standards that are developed in the future. The wireless link connecting the communication subsystem 104 with the wireless network 200 represents one or more different Radio Frequency (RF) channels, operating according to defined protocols specified for GSM/GPRS communications. With newer network protocols, these channels are capable of supporting both circuit switched voice communications and packet switched data communications.

Although the wireless network 200 associated with portable electronic device 100 is a GSM/GPRS wireless network in one exemplary implementation, other wireless networks may also be associated with the portable electronic device 100 in variant implementations. The different types of wireless networks that may be employed include, for example, data-centric wireless networks, voice-centric wireless networks, and dual-mode networks that can support both voice and data communications over the same physical base stations. Combined dual-mode networks include, but are not limited to, Code Division Multiple Access (CDMA) or CDMA2000 networks, GSM/GPRS networks (as mentioned above), and future third-generation (3G) networks such as EDGE and UMTS. Some other examples of data-centric networks include WiFi 802.11, Mobitex™ and DataTAC™ network communication systems. Examples of other voice-centric data networks include Personal Communication Systems (PCS) networks like GSM and Time Division Multiple Access (TDMA) systems. The main processor 102 also interacts with additional subsystems such as a Random Access Memory (RAM) 106, a flash memory 108, a display 110, an auxiliary input/output (I/O) subsystem 112, a data port 114, a trackball 115, a keyboard 116, a speaker 118, a microphone 120, short-range communications 122 and other device subsystems 124.

Some of the subsystems of the portable electronic device 100 perform communication-related functions, whereas other subsystems may provide "resident" or on-device functions. By way of example, the display 110, the trackball 115 and the keyboard 116 may be used for both communication-related functions, such as entering a text message for transmission over the network 200, and device-resident functions such as a calculator or task list.

The portable electronic device 100 can send and receive communication signals over the wireless network 200 after network registration or activation procedures have been completed. Network access is associated with a subscriber or user of the portable electronic device 100. To identify a subscriber, a SIM/RUIM card 126 (i.e. Subscriber Identity Module or a Removable User Identity Module) is inserted into a SIM/RUIM interface 128 in order to communicate with a network. The SIM/RUIM card 126 is a type of a conventional "smart card" that can be used to identify a subscriber of the portable electronic device 100 and to personalize the portable electronic device 100, among other things. In the present embodiment, the portable electronic device 100 is not fully operational for communication with the wireless network 200 without the SIM/RUIM card 126. By inserting the SIM/RUIM card 126 into the SIM/RUIM interface 128, a subscriber can access all subscribed services. Services may include: web browsing and messaging such as e-mail, voice mail, Short Message Service (SMS), and Multimedia Messaging Services (MMS). More advanced services may include: point of sale, field service and sales force automation. The SIM card/RUIM 126 includes a processor and memory for storing information. Once the SIM card/RUIM 126 is inserted into the SIM/RUIM interface 128, it is coupled to the main processor 102. In order to identify the subscriber, the SIM card/RUIM 126 can include some user parameters such as an International Mobile Subscriber Identity (IMSI). An advantage of using the SIM card/RUIM 126 is that a subscriber is not necessarily bound by any single physical portable electronic device. The SIM card/RUIM 126 may store additional subscriber information for a portable electronic device as well, including datebook (or calendar) information and recent call information. Alternatively, user identification information can also be programmed into the flash memory 108.

The portable electronic device 100 is a battery-powered device and includes a battery interface 132 for receiving one or more rechargeable batteries 130. In at least some embodiments, the battery 130 can be a smart battery with an embedded microprocessor. The battery interface 132 is coupled to a regulator (not shown), which assists the battery 130 in providing power V+ to the portable electronic device 100. Although current technology makes use of a battery, future technologies such as micro fuel cells may provide the power to the portable electronic device 100.

The portable electronic device 100 also includes an operating system 134 and software components 136 to 146 which are described in more detail below. The operating system 134 and the software components 136 to 146 that are executed by the main processor 102 are typically stored in a persistent store such as the flash memory 108, which may alternatively be a read-only memory (ROM) or similar storage element (not shown). Those skilled in the art will appreciate that portions of the operating system 134 and the software components 136 to 146, such as specific device applications, or parts thereof, may be temporarily loaded into a volatile store such as the RAM 106. Other software components can also be included, as is well known to those skilled in the art.

The subset of software applications 136 that control basic device operations, including data and voice communication applications are installed on the portable electronic device 100 during its manufacture. Other software applications include a message application 138 that can be any suitable software program that allows a user of the portable electronic device 100 to send and receive electronic messages. Various alternatives exist for the message application 138 as is well known to those skilled in the art. Messages that have been sent or received by the user are typically stored in the flash memory 108 of the portable electronic device 100 or some other suitable storage element in the portable electronic device 100. In at least some embodiments, some of the sent and received messages may be stored remotely from the device 100 such as in a data store of an associated host system that the portable electronic device 100 communicates with.

The software applications can further include a device state module 140, a Personal Information Manager (PIM) 142, and other suitable modules (not shown). The device state module 140 provides persistence, i.e. the device state module 140 ensures that important device data is stored in persistent memory, such as the flash memory 108, so that the data is not lost when the portable electronic device 100 is turned off or loses power.

The PIM 142 includes functionality for organizing and managing data items of interest to the user, such as, but not limited to, e-mail, contacts, calendar events, voice mails, appointments, and task items. PIM applications include, for example, calendar, address book, tasks and memo applications. The PIM applications have the ability to send and receive data items via the wireless network 200. PIM data items may be seamlessly integrated, synchronized, and updated via the wireless network 200 with the portable electronic device subscriber's corresponding data items stored and/or associated with a host computer system. This functionality creates a mirrored host computer on the portable electronic device 100 with respect to such items. This can be particularly advantageous when the host computer system is the portable electronic device subscriber's office computer system.

The portable electronic device 100 also includes a connect module 144, and an information technology (IT) policy module 146. The connect module 144 implements the communication protocols that are required for the portable electronic device 100 to communicate with the wireless infrastructure and any host system, such as an enterprise system, that the portable electronic device 100 is authorized to interface with. Examples of a wireless infrastructure and an enterprise system are given in FIGS. 3 and 4, which are described in more detail below.

The connect module 144 includes a set of APIs that can be integrated with the portable electronic device 100 to allow the portable electronic device 100 to use any number of services associated with the enterprise system. The connect module 144 allows the portable electronic device 100 to establish an end-to-end secure, authenticated communication pipe with the host system. A subset of applications for which access is provided by the connect module 144 can be used to pass IT policy commands from the host system to the portable electronic device 100. This can be done in a wireless or wired manner. These instructions can then be passed to the IT policy module 146 to modify the configuration of the device 100. Alternatively, in some cases, the IT policy update can also be done over a wired connection.

Other types of software applications can also be provided on the portable electronic device 100 and still others can be installed on the portable electronic device 100. Such software applications can be third party applications, which are added after the manufacture of the portable electronic device 100. Examples of third party applications include games, calculators, utilities, etc.

The additional applications can be loaded onto the portable electronic device 100 through at least one of the wireless network 200, the auxiliary I/O subsystem 112, the data port 114, the short-range communications subsystem 122, or any other suitable device subsystem 124. This flexibility in application installation increases the functionality of the portable electronic device 100 and may provide enhanced on-device functions, communication-related functions, or both. For example, secure communication applications may enable electronic commerce functions and other such financial transactions to be performed using the portable electronic device 100.

The data port 114 enables a subscriber to set preferences through an external device or software application and extends the capabilities of the portable electronic device 100 by providing for information or software downloads to the portable electronic device 100 other than through a wireless communication network. The alternate download path may, for example, be used to load an encryption key onto the portable electronic device 100 through a direct and thus reliable and trusted connection to provide secure device communication.

The data port 114 can be any suitable port that enables data communication between the portable electronic device 100 and another computing device. The data port 114 can be a serial or a parallel port. In some instances, the data port 114 can be a USB port that includes data lines for data transfer and a supply line that can provide a charging current to charge the battery 130 of the portable electronic device 100.

The short-range communications subsystem 122 provides for communication between the portable electronic device 100 and different systems or devices, without the use of the wireless network 200. For example, the subsystem 122 may include an infrared device and associated circuits and components for short-range communication. Examples of short-range communication standards include standards developed by the Infrared Data Association (IrDA), Bluetooth, and the 802.11 family of standards developed by IEEE.

In use, a received signal such as a text message, an e-mail message, Web page download, or any other information is processed by the communication subsystem 104 and input to the main processor 102. The main processor 102 will then process the received signal for output to the display 110 or alternatively to the auxiliary I/O subsystem 112. A subscriber may also compose data items, such as e-mail messages, for example, using the keyboard 116 in conjunction with the display 110 and possibly the auxiliary I/O subsystem 112. The auxiliary subsystem 112 may include devices such as: a touch screen, mouse, track ball, infrared fingerprint detector, or a roller wheel with dynamic button pressing capability. The keyboard 116 is preferably an alphanumeric keyboard and/or telephone-type keypad. However, other types of keyboards may also be used. A composed item may be transmitted over the wireless network 200 through the communication subsystem 104.

For voice communications, the overall operation of the portable electronic device 100 is substantially similar, except that the received signals are output to the speaker 118, and signals for transmission are generated by the microphone 120. Alternative voice or audio I/O subsystems, such as a voice message recording subsystem, can also be implemented on the portable electronic device 100. Although voice or audio signal output is accomplished primarily through the speaker 118, the display 110 can also be used to provide additional information such as the identity of a calling party, duration of a voice call, or other voice call related information.

Figure 2:
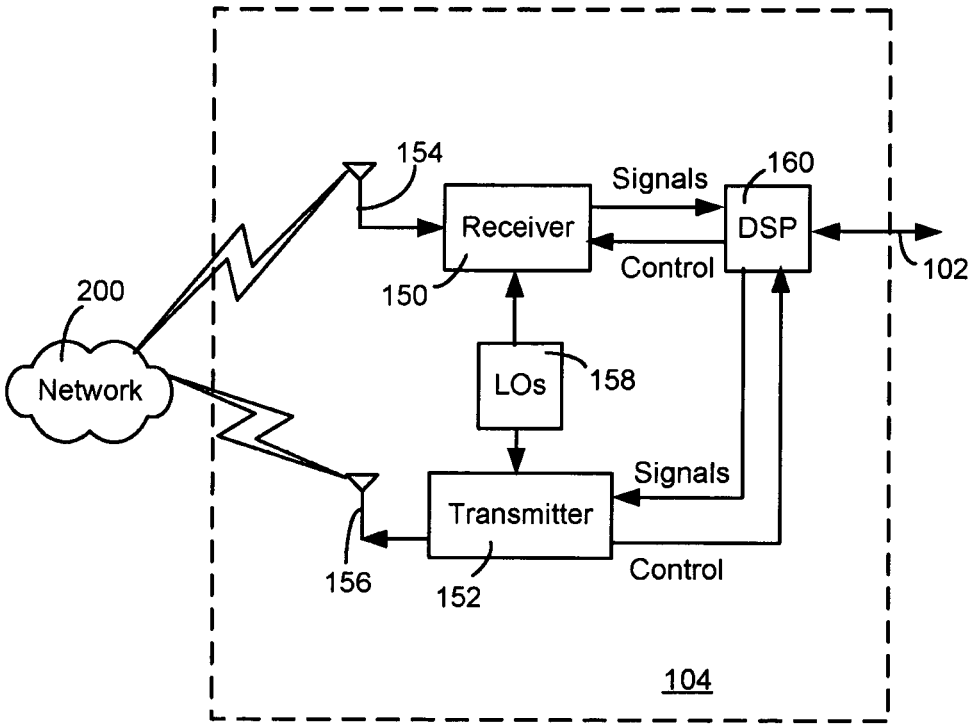
FIG. 2 is an exemplary block diagram of a communication subsystem component of FIG. 1.

Referring now to FIG. 2, an exemplary block diagram of the communication subsystem component 104 is shown. The communication subsystem 104 includes a receiver 150, a transmitter 152, as well as associated components such as one or more embedded or internal antenna elements 154 and 156, Local Oscillators (LOs) 158, and a processing module such as a Digital Signal Processor (DSP) 160. The particular design of the communication subsystem 104 is dependent upon the communication network 200 with which the portable electronic device 100 is intended to operate. Thus, it should be understood that the design illustrated in FIG. 2 serves only as one example.

Signals received by the antenna 154 through the wireless network 200 are input to the receiver 150, which may perform such common receiver functions as signal amplification, frequency down conversion, filtering, channel selection, and analog-to-digital (A/D) conversion. A/D conversion of a received signal allows more complex communication functions such as demodulation and decoding to be performed in the DSP 160. In a similar manner, signals to be transmitted are processed, including modulation and encoding, by the DSP 160. These DSP-processed signals are input to the transmitter 152 for digital-to-analog (D/A) conversion, frequency up conversion, filtering, amplification and transmission over the wireless network 200 via the antenna 156. The DSP 160 not only processes communication signals, but also provides for receiver and transmitter control. For example, the gains applied to communication signals in the receiver 150 and the transmitter 152 may be adaptively controlled through automatic gain control algorithms implemented in the DSP 160.

The wireless link between the portable electronic device 100 and the wireless network 200 can contain one or more different channels, typically different RF channels, and associated protocols used between the portable electronic device 100 and the wireless network 200. An RF channel is a limited resource that should be conserved, typically due to limits in overall bandwidth and limited battery power of the portable electronic device 100.

When the portable electronic device 100 is fully operational, the transmitter 152 is typically keyed or turned on only when it is transmitting to the wireless network 200 and is otherwise turned off to conserve resources. Similarly, the receiver 150 is periodically turned off to conserve power until it is needed to receive signals or information (if at all) during designated time periods.

Figure 3:
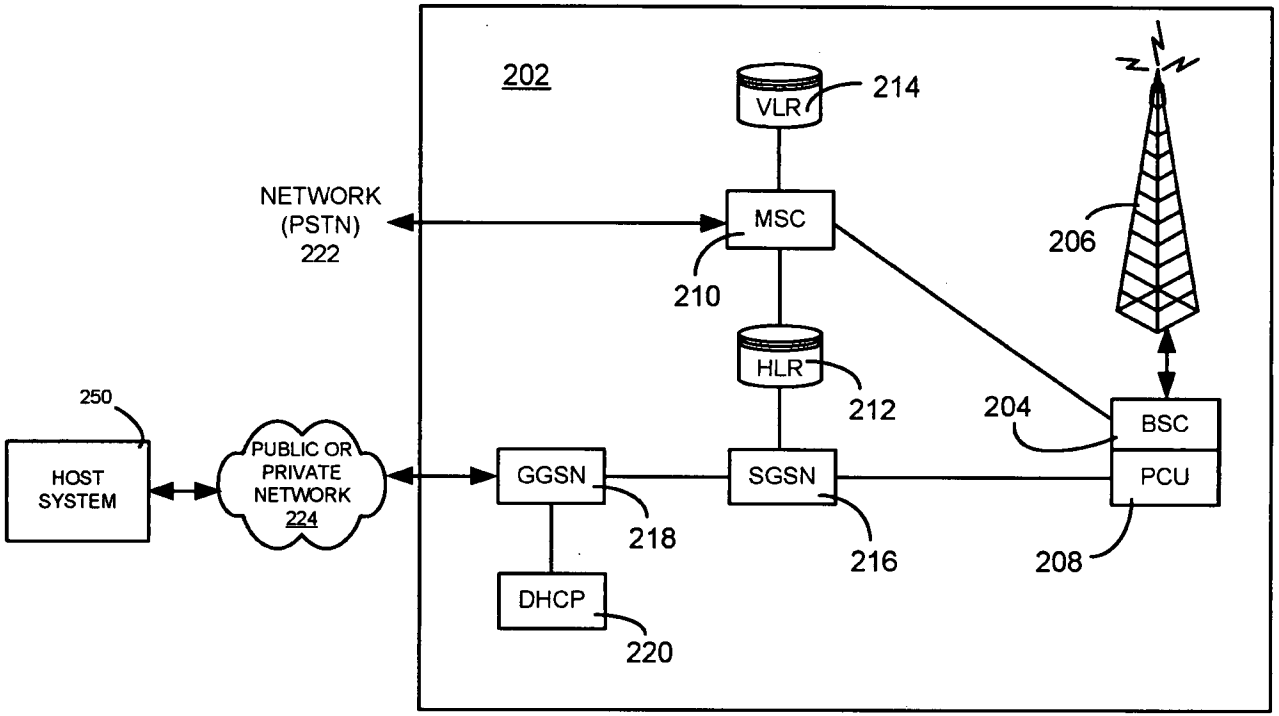
FIG. 3 is a block diagram of an exemplary implementation of a node of a wireless network.

Referring now to FIG. 3, a block diagram of an exemplary implementation of a node 202 of the wireless network 200 is shown. In practice, the wireless network 200 comprises one or more nodes 202. In conjunction with the connect module 144, the portable electronic device 100 can communicate with the node 202 within the wireless network 200. In the exemplary implementation of FIG. 3, the node 202 is configured in accordance with General Packet Radio Service (GPRS) and Global Systems for Mobile (GSM) technologies. The node 202 includes a base station controller (BSC) 204 with an associated tower station 206, a Packet Control Unit (PCU) 208 added for GPRS support in GSM, a Mobile Switching Center (MSC) 210, a Home Location Register (HLR) 212, a Visitor Location Registry (VLR) 214, a Serving GPRS Support Node (SGSN) 216, a Gateway GPRS Support Node (GGSN) 218, and a Dynamic Host Configuration Protocol (DHCP) 220. This list of components is not meant to be an exhaustive list of the components of every node 202 within a GSM/GPRS network, but rather a list of components that are commonly used in communications through the network 200.

In a GSM network, the MSC 210 is coupled to the BSC 204 and to a landline network, such as a Public Switched Telephone Network (PSTN) 222 to satisfy circuit switched requirements. The connection through the PCU 208, the SGSN 216 and the GGSN 218 to a public or private network (Internet) 224 (also referred to herein generally as a shared network infrastructure) represents the data path for GPRS capable portable electronic devices. In a GSM network extended with GPRS capabilities, the BSC 204 also contains the Packet Control Unit (PCU) 208 that connects to the SGSN 216 to control segmentation, radio channel allocation and to satisfy packet switched requirements. To track the location of the portable electronic device 100 and availability for both circuit switched and packet switched management, the HLR 212 is shared between the MSC 210 and the SGSN 216. Access to the VLR 214 is controlled by the MSC 210.

The station 206 is a fixed transceiver station and together with the BSC 204 form fixed transceiver equipment. The fixed transceiver equipment provides wireless network coverage for a particular coverage area commonly referred to as a "cell". The fixed transceiver equipment transmits communication signals to and receives communication signals from portable electronic devices within its cell via the station 206. The fixed transceiver equipment normally performs such functions as modulation and possibly encoding and/or encryption of signals to be transmitted to the portable electronic device 100 in accordance with particular, usually predetermined, communication protocols and parameters, under control of its controller. The fixed transceiver equipment similarly demodulates and possibly decodes and decrypts, if necessary, any communication signals received from the portable electronic device 100 within its cell. Communication protocols and parameters may vary between different nodes. For example, one node may employ a different modulation scheme and operate at different frequencies than other nodes.

For all portable electronic devices 100 registered with a specific network, permanent configuration data such as a user profile is stored in the HLR 212. The HLR 212 also contains location information for each registered portable electronic device and can be queried to determine the current location of a portable electronic device. The MSC 210 is responsible for a group of location areas and stores the data of the portable electronic devices currently in its area of responsibility in the VLR 214. Further, the VLR 214 also contains information on portable electronic devices that are visiting other networks. The information in the VLR 214 includes part of the permanent portable electronic device data transmitted from the HLR 212 to the VLR 214 for faster access. By moving additional information from a remote HLR 212 node to the VLR 214, the amount of traffic between these nodes can be reduced so that voice and data services can be provided with faster response times and at the same time requiring less use of computing resources.

The SGSN 216 and the GGSN 218 are elements added for GPRS support; namely packet switched data support, within GSM. The SGSN 216 and the MSC 210 have similar responsibilities within the wireless network 200 by keeping track of the location of each portable electronic device 100. The SGSN 216 also performs security functions and access control for data traffic on the wireless network 200. The GGSN 218 provides internetworking connections with external packet switched networks and connects to one or more SGSN's 216 via an Internet Protocol (IP) backbone network operated within the network 200. During normal operations, a given portable electronic device 100 must perform a "GPRS Attach" to acquire an IP address and to access data services. This requirement is not present in circuit switched voice channels as Integrated Services Digital Network (ISDN) addresses are used for routing incoming and outgoing calls. Currently, all GPRS capable networks use private, dynamically assigned IP addresses, thus requiring the DHCP server 220 connected to the GGSN 218. There are many mechanisms for dynamic IP assignment, including using a combination of a Remote Authentication Dial-In User Service (RADIUS) server and a DHCP server. Once the GPRS Attach is complete, a logical connection is established from a portable electronic device 100, through the PCU 208, and the SGSN 216 to an Access Point Node (APN) within the GGSN 218. The APN represents a logical end of an IP tunnel that can either access direct Internet compatible services or private network connections. The APN also represents a security mechanism for the network 200, insofar as each portable electronic device 100 must be assigned to one or more APNs and portable electronic devices 100 cannot exchange data without first performing a GPRS Attach to an APN that it has been authorized to use. The APN may be considered to be similar to an Internet domain name such as "myconnection-.wireless.com".

Once the GPRS Attach operation is complete, a tunnel is created and all traffic is exchanged within standard IP packets using any protocol that can be supported in IP packets. This includes tunneling methods such as IP over IP as in the case with some IPSecurity (IPsec) connections used with Virtual Private Networks (VPN). These tunnels are also referred to as Packet Data Protocol (PDP) Contexts and there are a limited number of these available in the network 200. To maximize use of the PDP Contexts, the network 200 will run an idle timer for each PDP Context to determine if there is a lack of activity. When a portable electronic device 100 is not using its PDP Context, the PDP Context can be de-allocated and the IP address returned to the IP address pool managed by the DHCP server 220.

Figure 4:
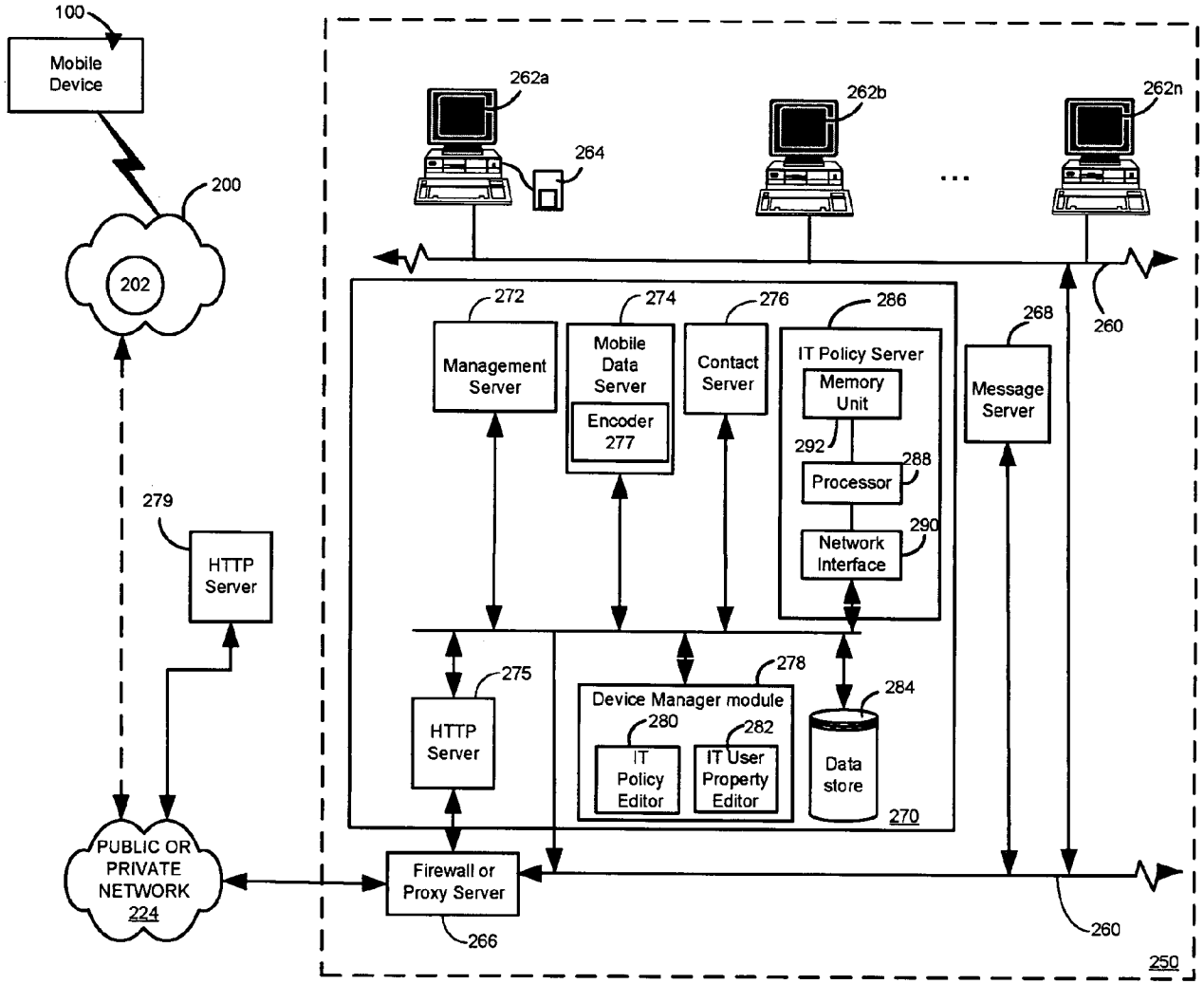

Referring now to FIG. 4, shown therein is a block diagram illustrating components of an exemplary configuration of a host system 250 that the portable electronic device 100 can communicate with in conjunction with the connect module 144. The host system 250 will typically be a corporate enterprise or other local area network (LAN), but may also be a home office computer or some other private system, for example, in variant implementations. In this example shown in FIG. 4, the host system 250 is depicted as a LAN of an organization to which a user of the portable electronic device 100 belongs. Typically, a plurality of portable electronic devices can communicate wirelessly with the host system 250 through one or more nodes 202 of the wireless network 200.

The host system 250 comprises a number of network components connected to each other by a network 260. For instance, a user's desktop computer 262*a* with an accompanying cradle 264 for the user's portable electronic device 100 is situated on a LAN connection. The cradle 264 for the portable electronic device 100 can be coupled to the computer 262*a* by a serial or a Universal Serial Bus (USB) connection, for example. Other user computers 262*b*-262*n* are also situated on the network 260, and each may or may not be equipped with an accompanying cradle 264. The cradle 264 facilitates the loading of information (e.g. PIM data, private symmetric encryption keys to facilitate secure communications) from the user computer 262*a* to the portable electronic device 100, and may be particularly useful for bulk information updates often performed in initializing the portable electronic device 100 for use. The information downloaded to the portable electronic device 100 may include certificates used in the exchange of messages.

It will be understood by persons skilled in the art that the user computers 262*a*-262*n* will typically also be connected to other peripheral devices, such as printers, etc. which are not explicitly shown in FIG. 4. Furthermore, only a subset of network components of the host system 250 are shown in FIG. 4 for ease of exposition, and it will be understood by persons skilled in the art that the host system 250 will comprise additional components that are not explicitly shown in FIG. 4 for this exemplary configuration. More generally, the host system 250 may represent a smaller part of a larger network (not shown) of the organization, and may comprise different components and/or be arranged in different topologies than that shown in the exemplary embodiment of FIG. 4.

To facilitate the operation of the portable electronic device 100 and the wireless communication of messages and message-related data between the portable electronic device 100 and components of the host system 250, a number of wireless communication support components 270 can be provided. In some implementations, the wireless communication support components 270 can include a management server 272, a mobile data server (MDS) 274, a web server, such as Hypertext Transfer Protocol (HTTP) server 275, a contact server 276, and a device manager module 278. HTTP servers can also be located outside the enterprise system, as indicated by the HTTP server 275 attached to the network 224. The device manager module 278 includes an IT Policy editor 280 and an IT user property editor 282, as well as other software components for allowing an IT administrator to configure the portable electronic devices 100. In an alternative embodiment, there may be one editor that provides the functionality of both the IT policy editor 280 and the IT user property editor 282. The support components 270 also include a data store 284, and an IT policy server 286. The IT policy server 286 includes a processor 288, a network interface 290 and a memory unit 292. The processor 288 controls the operation of the IT policy server 286 and executes functions related to the standardized IT policy as described below. The network interface 290 allows the IT policy server 286 to communicate with the various components of the host system 250 and the portable electronic devices 100. The memory unit 292 can store functions used in implementing the IT policy as well as related data. Those skilled in the art know how to implement these various components. Other components may also be included as is well known to those skilled in the art. Further, in some implementations, the data store 284 can be part of any one of the servers.

In this exemplary embodiment, the portable electronic device 100 communicates with the host system 250 through node 202 of the wireless network 200 and a shared network infrastructure 224 such as a service provider network or the public Internet. Access to the host system 250 may be provided through one or more routers (not shown), and computing devices of the host system 250 may operate from behind a firewall or proxy server 266. The proxy server 266 provides a secure node and a wireless internet gateway for the host system 250. The proxy server 266 intelligently routes data to the correct destination server within the host system 250.

In some implementations, the host system 250 can include a wireless VPN router (not shown) to facilitate data exchange between the host system 250 and the portable electronic device 100. The wireless VPN router allows a VPN connection to be established directly through a specific wireless network to the portable electronic device 100. The wireless VPN router can be used with the Internet Protocol (IP) Version 6 (IPV6) and IP-based wireless networks. This protocol can provide enough IP addresses so that each portable electronic device has a dedicated IP address, making it possible to push information to a portable electronic device at any time. An advantage of using a wireless VPN router is that it can be an off-the-shelf VPN component, and does not require a separate wireless gateway and separate wireless infrastructure. A VPN connection can preferably be a Transmission Control Protocol (TCP)/IP or User Datagram Protocol (UDP)/IP connection for delivering the messages directly to the portable electronic device 100 in this alternative implementation.

Messages intended for a user of the portable electronic device 100 are initially received by a message server 268 of the host system 250. Such messages may originate from any number of sources. For instance, a message may have been sent by a sender from the computer 262*b* within the host system 250, from a different portable electronic device (not shown) connected to the wireless network 200 or a different wireless network, or from a different computing device, or other device capable of sending messages, via the shared network infrastructure 224, possibly through an application service provider (ASP) or Internet service provider (ISP), for example.

The message server 268 typically acts as the primary interface for the exchange of messages, particularly e-mail messages, within the organization and over the shared network infrastructure 224. Each user in the organization that has been set up to send and receive messages is typically associated with a user account managed by the message server 268. Some exemplary implementations of the message server 268 include a Microsoft Exchange™ server, a Lotus Domino™ server, a Novell Groupwise™ server, or another suitable mail server installed in a corporate environment. In some implementations, the host system 250 may comprise multiple message servers 268. The message server provides additional functions including PIM functions such as calendaring, contacts and tasks and supports data storage.

When messages are received by the message server 268, they are typically stored in a data store associated with the message server 268. In at least some embodiments, the data store may be a separate hardware unit, such as data store 284, that the message server 268 communicates with. Messages can be subsequently retrieved and delivered to users by accessing the message server 268. For instance, an e-mail client application operating on a user's computer 262*a* may request the e-mail messages associated with that user's account stored on the data store associated with the message server 268. These messages are then retrieved from the data store and stored locally on the computer 262*a*. The data store associated with the message server 268 can store copies of each message that is locally stored on the portable electronic device 100. Alternatively, the data store associated with the message server 268 can store all of the messages for the user of the portable electronic device 100 and only a smaller number of messages can be stored on the portable electronic device 100 to conserve memory. For instance, the most recent messages (i.e. those received in the past two to three months for example) can be stored on the portable electronic device 100.

When operating the portable electronic device 100, the user may wish to have e-mail messages retrieved for delivery to the portable electronic device 100. The message application 138 operating on the portable electronic device 100 may also request messages associated with the user's account from the message server 268. The message application 138 may be configured (either by the user or by an administrator, possibly in accordance with an organization's IT policy) to make this request at the direction of the user, at some predefined time interval, or upon the occurrence of some predefined event. In some implementations, the portable electronic device 100 is assigned its own e-mail address, and messages addressed specifically to the portable electronic device 100 are automatically redirected to the portable electronic device 100 as they are received by the message server 268.

The management server 272 can be used to specifically provide support for the management of, for example, messages, such as e-mail messages, that are to be handled by portable electronic devices. Generally, while messages are still stored on the message server 268, the management server 272 can be used to control when, if, and how messages are sent to the portable electronic device 100. The management server 272 also facilitates the handling of messages composed on the portable electronic device 100, which are sent to the message server 268 for subsequent delivery.

For example, the management server 272 may monitor the user's "mailbox" (e.g. the message store associated with the user's account on the message server 268) for new e-mail messages, and apply user-definable filters to new messages to determine if and how the messages are relayed to the user's portable electronic device 100. The management server 272 may also, through an encoder 273, compress messages, using any suitable compression technology (e.g. YK compression, and other known techniques) and encrypt messages (e.g. using an encryption technique such as Data Encryption Standard (DES), Triple DES, or Advanced Encryption Standard (AES)), and push them to the portable electronic device 100 via the shared network infrastructure 224 and the wireless network 200. The management server 272 may also receive messages composed on the portable electronic device 100 (e.g. encrypted using Triple DES), decrypt and decompress the composed messages, re-format the composed messages if desired so that they will appear to have originated from the user's computer 262*a*, and re-route the composed messages to the message server 268 for delivery.

Certain properties or restrictions associated with messages that are to be sent from and/or received by the portable electronic device 100 can be defined (e.g. by an administrator in accordance with IT policy) and enforced by the management server 272. These may include whether the portable electronic device 100 may receive encrypted and/or signed messages, minimum encryption key sizes, whether outgoing messages must be encrypted and/or signed, and whether copies of all secure messages sent from the portable electronic device 100 are to be sent to a pre-defined copy address, for example.

The management server 272 may also be adapted to provide other control functions, such as only pushing certain message information or pre-defined portions (e.g. "blocks") of a message stored on the message server 268 to the portable electronic device 100. For example, in some cases, when a message is initially retrieved by the portable electronic device 100 from the message server 268, the management server 272 may push only the first part of a message to the portable electronic device 100, with the part being of a pre-defined size (e.g. 2 KB). The user can then request that more of the message be delivered in similar-sized blocks by the management server 272 to the portable electronic device 100, possibly up to a maximum pre-defined message size. Accordingly, the management server 272 facilitates better control over the type of data and the amount of data that is communicated to the portable electronic device 100, and can help to minimize potential waste of bandwidth or other resources.

The MDS 274 encompasses any other server that stores information that is relevant to the corporation. The mobile data server 274 may include, but is not limited to, databases, online data document repositories, customer relationship management (CRM) systems, or enterprise resource planning (ERP) applications. The MDS 274 can also connect to the Internet or other public network, through HTTP server 275 or other suitable web server such as an File Transfer Protocol (FTP) server, to retrieve HTTP webpages and other data. Requests for webpages are typically routed through MDS 274 and then to HTTP server 275, through suitable firewalls and other protective mechanisms. The web server then retrieves the webpage over the Internet, and returns it to MDS 274. As described above in relation to management server 272, MDS 274 is typically provided, or associated, with an encoder 277 that permits retrieved data, such as retrieved webpages, to be compressed, using any suitable compression technology (e.g. YK compression, and other known techniques), and encrypted (e.g. using an encryption technique such as DES, Triple DES, or AES), and then pushed to the portable electronic device 100 via the shared network infrastructure 224 and the wireless network 200.

The contact server 276 can provide information for a list of contacts for the user in a similar fashion as the address book on the portable electronic device 100. Accordingly, for a given contact, the contact server 276 can include the name, phone number, work address and e-mail address of the contact, among other information. The contact server 276 can also provide a global address list that contains the contact information for all of the contacts associated with the host system 250.

It will be understood by persons skilled in the art that the management server 272, the MDS 274, the HTTP server 275, the contact server 276, the device manager module 278, the data store 284 and the IT policy server 286 do not need to be implemented on separate physical servers within the host system 250. For example, some or all of the functions associated with the management server 272 may be integrated with the message server 268, or some other server in the host system 250. Alternatively, the host system 250 may comprise multiple management servers 272, particularly in variant implementations where a large number of portable electronic devices need to be supported.

The device manager module 278 provides an IT administrator with a graphical user interface with which the IT administrator interacts to configure various settings for the portable electronic devices 100. As mentioned, the IT administrator can use IT policy rules to define behaviors of certain applications on the portable electronic device 100 that are permitted such as phone, web browser or Instant Messenger use. The IT policy rules can also be used to set specific values for configuration settings that an organization requires on the portable electronic devices 100 such as auto signature text, WLAN/VoIP/VPN configuration, security requirements (e.g. encryption algorithms, password rules, etc.), specifying themes or applications that are allowed to run on the portable electronic device 100, and the like.

As indicated above, the portable electronic device 100 includes the Personal Information Manager (PIM) 142 that includes functionality for organizing and managing data items of interest to the user, such as, but not limited to, e-mail, contacts, calendar events, voice mails, appointments, and task items. PIM applications include, for example, calendar, address book, tasks and memo applications.

The profiles application is used for selection and customization of notification modes by user selection from a number of different notifications set for the occurrence of specific events. Each profile can be customized to give rise to different notification output for various applications on the portable electronic device 100.

Figure 5:
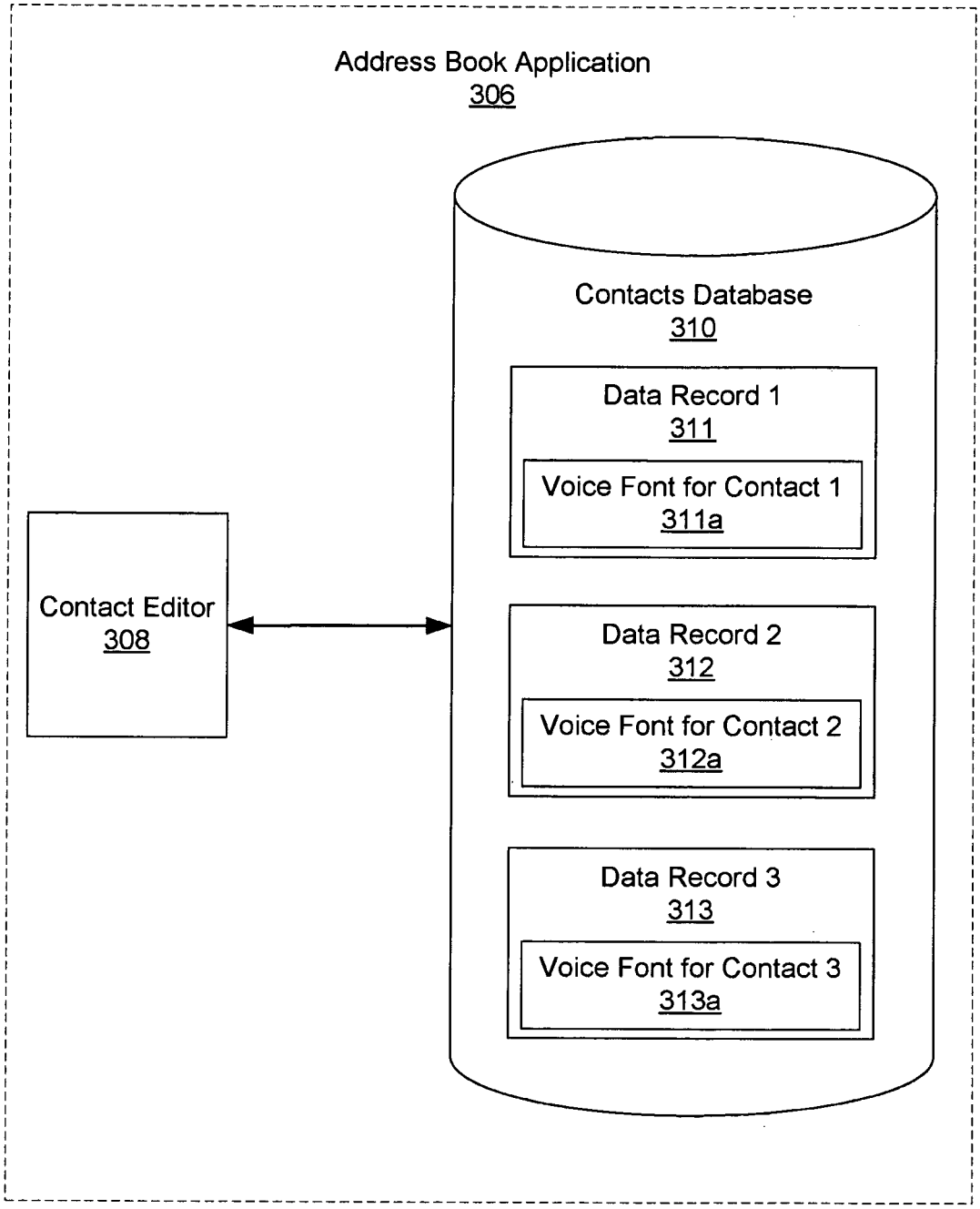
FIG. 5 is a schematic diagram of an address book application.

Reference is now made to FIG. 5, which shows a schematic illustration of address book application 306. The address book application, when executed by the processor 102, provides a graphical user interface for creating, editing, and viewing address book data in the form of contact data records. In particular, the contact editor 308 is part of the address book application 306 and allows for the user to create and edit contacts data records for storage in the contacts database, identified by the numeral 310 of the flash memory 108. The contacts database 310 contains data records 311, 312, and 313, which include contact data such as contacts' respective names, addresses, email addresses, telephone numbers, and, in the present application, voice fonts 311*a*, 312*a*, and 313*a*, as well as other information.

Figure 6:
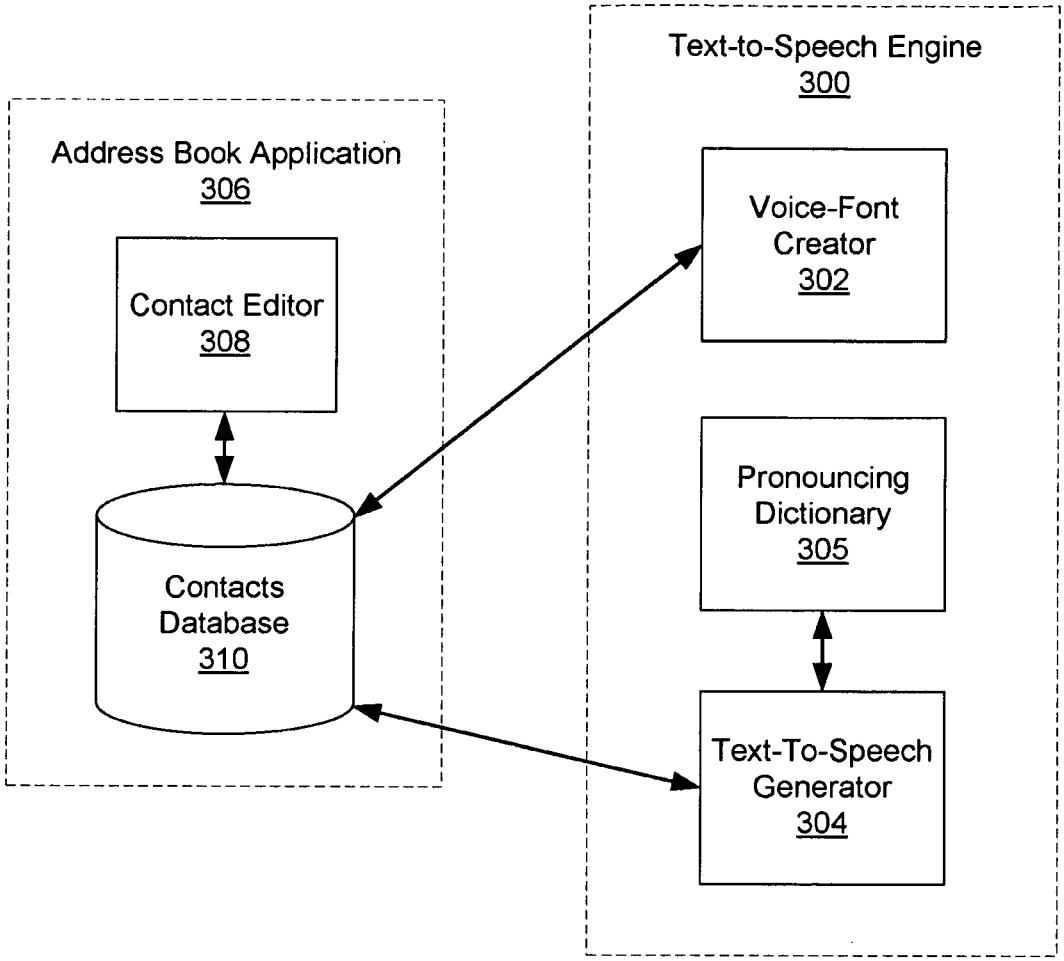
FIG. 6 is a schematic illustration of the relationship between functional components of the portable electronic device including an address book application and a text-to-speech engine.

Reference is now made to FIG. 6, which shows a schematic illustration of the relationship between address book application 306 and text-to-speech engine 300, the latter being amongst the programs 136 stored in the flash memory 108 and executable by the processor 108. The text-to-speech engine 300 includes a voice-font creator 302 for creating voice fonts for storage in relation to contacts database 310 and a text-to-speech generator 304 for converting text into speech using the stored voice fonts. The contacts database 310 is functionally connected to both the voice-font creator 302 and to the text-to-speech generator 304 to facilitate the addition, deletion and modification of voice fonts stored in respective ones of the contact data records at the contacts database 310 and to facilitate identification and use of the voice fonts in generating speech from text.

The voice-font creator 302 is responsible for receiving and recording voice dictation in the form of raw audio streams. In one example, predetermined text, chosen to include all possible voice units, is dictated to the portable electronic device 100 via the microphone 120. Alternatively, the audio stream received is not predetermined. As is understood is the art (and will be detailed later), an arbitrary sample of a speaker's voice might or might not include all the different sounds needed to create a speech font. The voice-font creator 302 is responsible for receiving the dictation as a raw audio stream (or possibly more than one, if a predetermined text is not dictated and an initial sample of a speaker's voice is inadequate) in the form of a digital or analog waveform; segmenting the audio stream—using techniques known in the art of speech processing—into segments, called voice units herein, corresponding to speech units; and determining which voice units correspond to which speech units. A voice font for a given speaker comprises a mapping of speech units to respective voice units. Speech units, as defined herein, are linguistic abstractions designed to represent a continuous stream of audio voice data as a manageable sequence of discrete pieces. Voice units, as defined herein, are actual audio waveform segments recorded from the speech of one person and corresponding to respective speech units. The voice units are audio building blocks from which artificial speech will be constructed, and the speech units are an intermediate tool used for determining how corresponding voice units will be sequenced.

As is known in the art, speech units may be, for example, phonemes. Phonemes are abstractions that represent a segment of speech that allows a speaker or listener to distinguish different words from one another. The set of phonemes will depend on the language and perhaps event the dialect of the speaker/listener. For example, in English, the phoneme /p/ in the word "pit" orally/aurally distinguishes that word from "kit". The same abstract phoneme /p/ represents the "p-sounds" in both the words "pit" and "spit", even though the /p/ in "spit" lacks the aspiration of the /p/ in "pit". In other languages, aspirated /$p^h$/ and unaspirated /p/ are separate phonemes because two words may be orally/aurally distinguished by the particular "p-sound".

Thus, in one example, speech units are phonemes of the language of the text-to-speech system. Clearly, this is a minimalist embodiment in that the text-to-speech generator will not distinguish between different allophones (for example [p] and [$p^h$]) of a phoneme (for example /p/). The voice font in this minimalist example would provide only a single voice unit (waveform segment) for the "p-sound". Such a minimalist system would be understandable to a listener, but the speech generated would sound more like the target speaker for some words than for others. Since the set of phonemes depends on the speaker/listener's language, a phoneme-based voice font will have a target language or dialect.

In a more sophisticated example, speech units are phones (for example [p], [$p^h$], etc.). The voice font could store multiple pronunciations of each phoneme. In conjunction with a more sophisticated, phonetic pronouncing dictionary (described later) or, alternatively, with a phonemic pronouncing dictionary (also described later) together with phonological rules (for example, "use unaspirated [p] after an /s/"), and the speech generated by a phone-based system would use the appropriate allophone of each phoneme in each environment. Given the vast number of phonetic sounds used in the languages of the world, it is anticipated that a phone-based text-to-speech system would also have a target language or dialect.

As mentioned previously, a predetermined text may be dictated by a target speaker, and such a text should include all voice units of the target language. Alternatively, raw audio data from the target speaker could be gathered until a sample of each voice unit is included. It is now evident that regardless of how raw audio data is collected from a target speaker for a phoneme-based text-to-speech system, the voice sample(s) would need to include all phonemes of the target language, whereas a phone-based text-to-speech system would need to include all the phones of the target language. The use of a predetermined text assures that all needed voice units are collected efficiently; moreover, the segmenting of the raw audio stream into voice units corresponding to speech units is aided by an expected sequence of speech units.

In yet another variation, it is known in the art to further enhance the generated speech by varying the pitch, speed, and volume to mimic the intonation of the target speaker. These enhancements require an analysis of the text at the level of an entire sentence, not just an individual word. For example, if the system is programmed to recognize a question and the target language is English, rising intonation at the end of the sentence can be imparted to the speech. As is well known in the art, in many languages intonation must be imparted to orally/aurally distinguish different words from one another;

The text-to-speech generator 304 is responsible for converting received text into speech. Conversion is done by first converting the text into a sequence of speech units. Each speech unit is then translated into a corresponding voice unit according to the voice font for the target speaker.

Many languages are not phonemic in nature. In other words, a glyph (letter, etc.) or short combination of glyphs (for example "ch") is not always pronounced as the same phoneme. Therefore, text-to-speech engine 300 may contain a pronouncing dictionary 305 which maps words to respective pronunciations. The pronouncing dictionary 305 may be a phonemic pronouncing dictionary, wherein words are mapped to respective phonemic transcriptions (i.e., sequences of phonemes). A more sophisticated pronouncing dictionary 305 may be a phonetic pronouncing dictionary, wherein words are mapped to respective phonetic transcriptions (i.e., sequences of phones).

In a phoneme-based text-to-speech system with a phonemic target language, the text-to-speech generator could directly translate a string of text into a phonemic transcription, without the need for pronouncing dictionary 305. In a phoneme-based text-to-speech system with a non-phonemic target language, the text-to-speech generator could use a phonemic pronouncing dictionary 305 to translate a string of text into a phonemic transcription. In a phone-based text-to-speech system, the text-to-speech generator could use a phonetic pronouncing dictionary 305 to translate a string of text directly into a phonetic transcription; alternatively, it could use a phonemic dictionary together with a set of phonological rules to determine which allophone of each phoneme to use in the output phonetic transcription; the phonological rules choose amongst allophones based on the environment of a phoneme.

In any of the variations described above, the text-to-speech generator receives text for conversion into speech, and, with or without a pronouncing dictionary 305, generates a sequence of speech units. Then, the voice font is used to look up the corresponding voice units in turn, and concatenate these waveform segments to generate speech.

Figure 7:
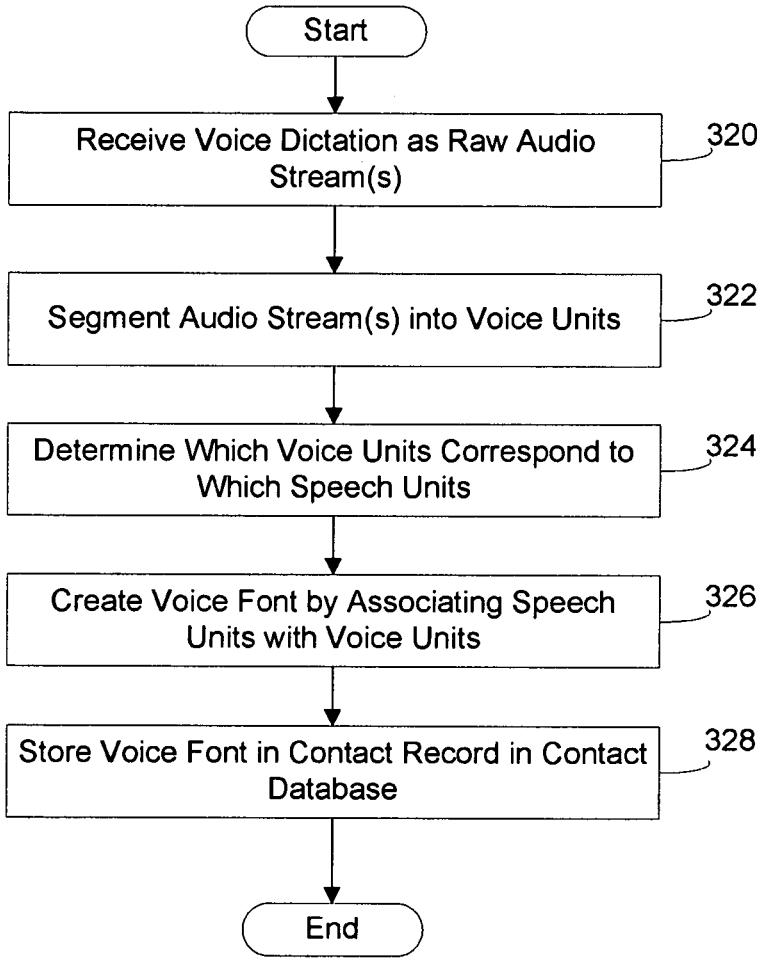
FIG. 7 is a flowchart illustrating steps in a method of associating a voice font with a contact record at the portable electronic device.

Reference is now made to FIG. 7 to describe steps in an exemplary method of creating a voice font at the portable electronic device 20 and associating it with a contact record. As indicated, the voice-font creator 302 is responsible for receiving and recording voice dictation. It will be appreciated that during contact creation or during contact editing using the contact editor 308, entry or editing of contact data is provided via a graphical user interface (GUI). The contact data can include, for example, the name, address, telephone numbers, email addresses, and other information that can be added to a contact data record for storage in the contacts database 310. In addition, a voice font can be added to the contact data record using any suitable method. For example, a voice font can be added by selection of an option to add a voice font in the contact editor GUI referred to above, causing the voice-font creator 302 to receive and record voice dictation. Predetermined text can be provided on the display 110 of the portable electronic device 100 for dictation by the individual being added as a contact, for example. The dictation is received at the microphone of the portable electronic device 100 (step 320). The voice units of the dictated speech are then determined. Thus, the dictated speech is parsed, by any manner known in the art of speech recognition, into voice units (step 322). The voice units are associated with speech units (step 324) and stored as a voice font (for example 311*a*) in the contacts database 310, in the contact data record (for example 311) created or edited using the contact editor GUI as referred to above (step 326). Thus, the voice units, in association with the speech units of the target language, are stored in the contacts database 310 for use by the text-to-speech generator 304.

Continued reference is made to FIG. 7 with additional reference to FIGS. 8A to 8E to describe an example of the method of associating a voice font with a contact record at the portable electronic device 20.

As indicated above, contact data can include, for example, the name, address, telephone numbers, email addresses, and other information that can be added to a contact data record for storage in the contacts database 310. A voice font can be added by selection of an option to add a voice font in the contact editor GUI referred to above. For the purpose of the present example, an existing contact is edited to add a voice font. It will be appreciated, however that a new contact can also be added and the voice font added when the new contact is created.

Figure 8A:
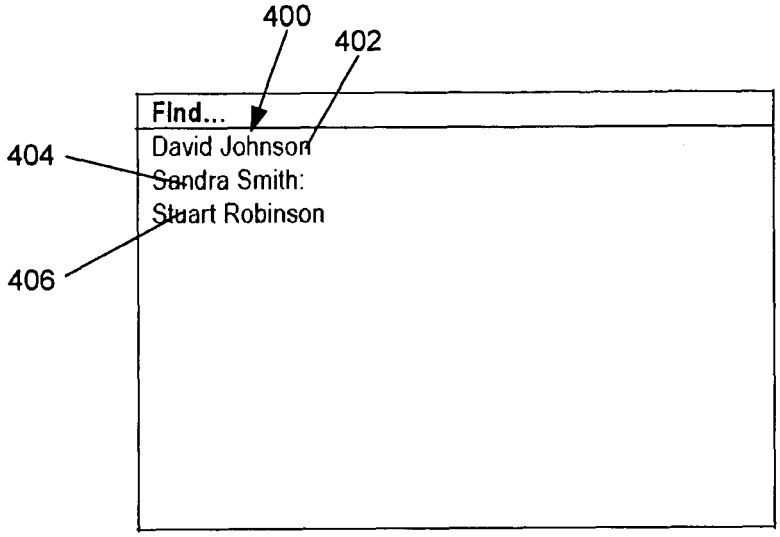
FIGS. 8A to 8F show examples of screen shots in steps of the method of associating a voice font with a contact record according to FIG. 7
Figure 8B:
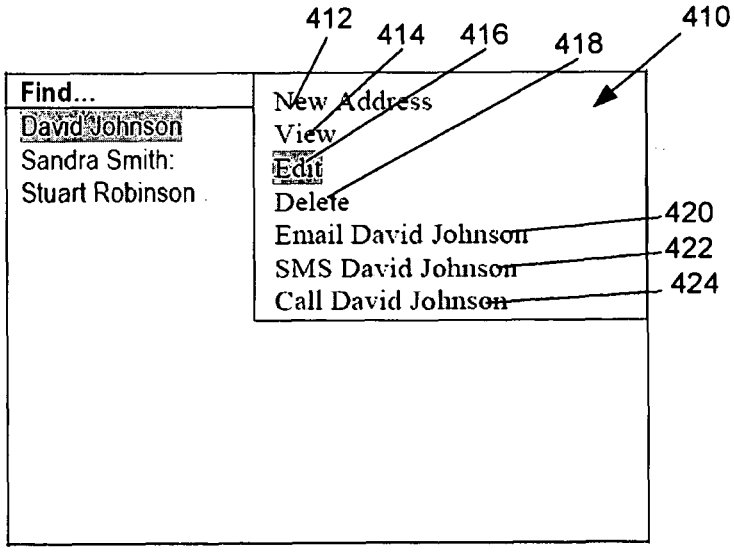

Referring to FIG. 8A, a user enters the address book application 306 by, for example, selection of the address book application 306 from a list of applications. Selection of the address book application 306 may be carried out in any suitable manner such as by scrolling, using the trackball 115, through the list of applications (each represented by an indicia, such as an icon) to highlight the address book application, followed by depression of the trackball to select the application. In the example shown in FIG. 8A, selection of the address book application 306 results in a list of contact records 400. The list of contact records includes three names of contacts 402, 404, 406 which, for the purpose of the present example, correspond with contact records 311, 312, 313 stored in contacts database 310 and shown in FIG. 5. Each of the names of the contacts 402, 404, 406 is user-selectable and selection of any one of the names of the contacts 402, 404, 406 results in a menu-list of user-selectable options 410 as shown in FIG. 8B. In the present example, the menu-list of user selectable options 410 includes a "New Address" option 412 to create a new contact record, a "View" option 414 to view the contact data in a contact record, an "Edit" option 416 to edit the contact record, a "Delete" option 418 to delete the contact record, an "Email" option 420 to email the contact, an "SMS" option 422 to send an SMS message to the contact, and a "Call" option 424 to call the contact.

Figure 8C:
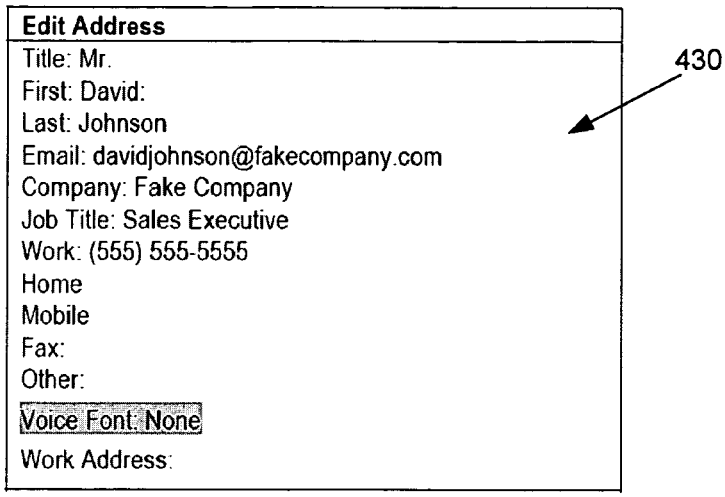
Figure 8D:
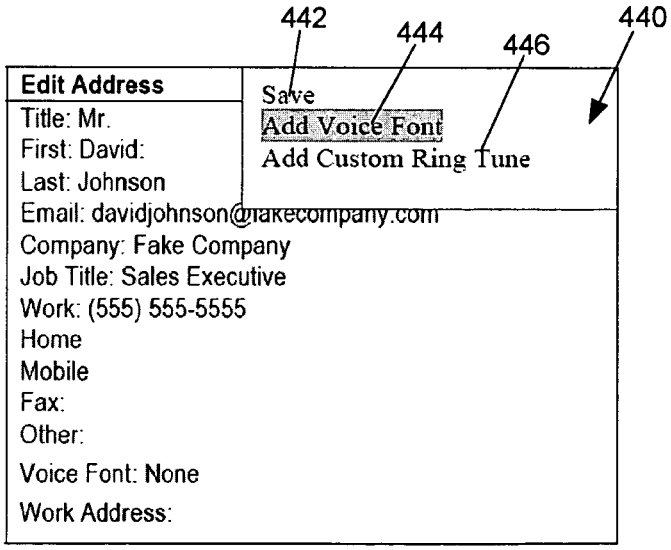

Selection of the "Edit" option 416 permits editing of the corresponding contact record in an editing GUI 430 shown in FIG. 8C, using the contact editor 308. In the present example, the editing GUI 430 permits editing of the data in each of the fields of the contact record and addition of data to fields by user-selection of the field. The fields of the contact record include a "Voice Font" field 432 for the addition of a voice font to the contact data record. In the present example, there is no voice font in the contact record and therefore the "Voice Font" field 432 indicates "None". Selection of the "Voice Font" field results in a sub-menu list of user-selectable options 440 including an option to "Save" 442 for saving the contact record, an option to "Add Voice Font" 444 for adding a voice font to the contact record and an option to "Add Custom Ring Tune" 446 for adding a custom ring tune to the contact record.

Figure 8E:
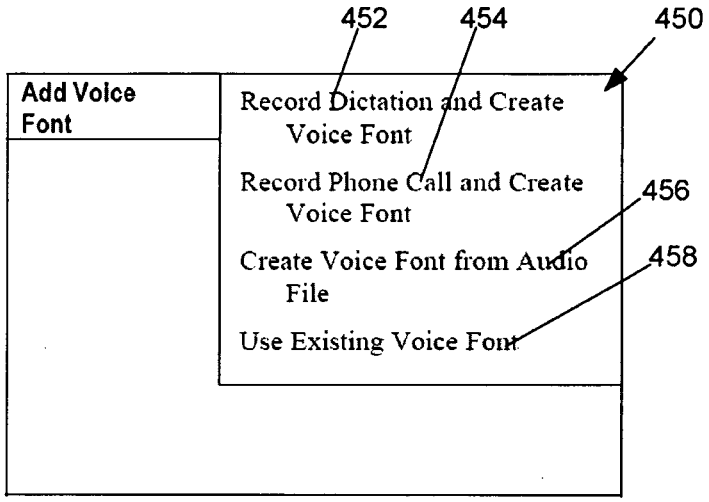

User-selection of the "Add Voice Font" option 444 can result in the display of a further screen specifically corresponding to one of the following four example approaches to adding a voice font to the contact record. Each of these specific screens can be reached via a voice font addition screen 450 displaying user-selectable options for some or, as shown in FIG. 8E, all of these approaches. Option 452 permits recording from the microphone 120 to create a voice font from the resulting recording. Option 454 permits recording from a phone call in progress to create a voice font from the resulting recording. Option 456 permits creating a voice font from an existing audio file previously stored on the portable electronic device 100. Option 458 permits using an existing voice font previously stored on the portable electronic device 100.

Figure 8F:
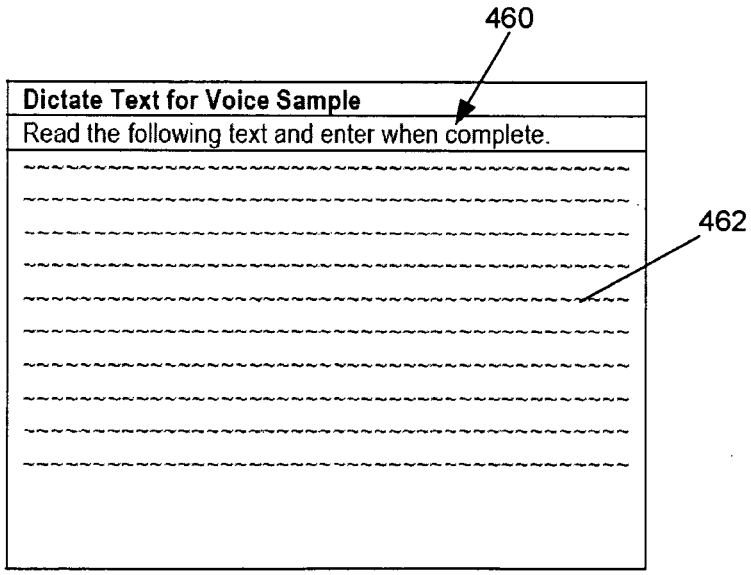

In a first example approach to adding a voice font to a contact record, user-selection of the "Record Dictation and Create Voice Font" option 452 results in the display of a dictate-text screen 460, as shown in FIG. 8F, including text 462 for reading by the contact ("David Johnson" in the present example). The user may begin and end recording of the dictation by, for example, pressing inwardly on the trackball 115, returning the user to the screen shown in FIG. 8C, for example. The text is therefore provided on the display 110 of the portable electronic device 100 for dictation by the contact (the person associated with the contact data record). It will be understood that a more elaborate version of the dictate-text screen 460 could include user-selectable controls to start, stop, or pause the recording process and, upon completion of the recording, could provide options to review, save, or delete the recording. Alternatively, one or more unscripted voice samples could be recorded.

As described above, the dictation is received at the microphone 120 of the portable electronic device 100 (step 320). The voice units of the dictated speech are then determined. Thus, the dictated speech is parsed, by any manner known in the art of speech recognition, into voice units (step 322). The voice units are associated with speech units (step 324) and stored as a voice font 311*a* in the contacts database 310, in the contact data record 311 created or edited using the contact editor GUI as referred to above (step 326). The voice units, in association with the speech units of the target language, are therefore stored in the contacts database 310 for use by the text-to-speech generator 304.

In a second example approach to adding a voice font to a contact record, user-selection of the "Record Phone Call and Create Voice Font" option 454 results in the user of the portable electronic device 100 being enabled to start and stop the recording of the pre-determined text (sent to the contact, previously or in response to the selection of option 454) or any other voice sample(s) during a phone call with the contact. A GUI screen for this recording operation (not shown) can include user-selectable controls to start, stop, or pause the recording process. Thus, the voice can be recorded during the telephone call at step 320. Again, the basic voice units of the dictated speech are then determined (step 322), associated with speech units of the target language (step 324), and stored as a voice font (for example 311*a*) in the contacts database 310, in the contact data record (for example 311) created or edited using the contact editor GUI as referred to above (step 326).

In a third example approach to adding a voice font to a contact record, user-selection of the "Create Voice Font from Audio File" option 456 results in the display of a GUI (not shown) for browsing, in any known manner, to enable the user to locate and select a digital audio file previously stored on device 100. The audio file could have been transmitted to the portable electronic device 100 or recorded on removable memory that was inserted in the device. From the digital audio file, the voice units can be determined, associated with the speech units of the target language, and stored as a voice font (for example, 311*a*), in the appropriate one of the contact data records (for example, 311) in the contacts database 310.

In a fourth example approach to adding a voice font to a contact record, user-selection of the "Use Existing Voice Font" option 458 results the display of a GUI (not shown) for browsing, in any known manner, to enable the user to locate and select a voice font file previously stored on device 100. The voice font file could have been transmitted to the portable electronic device 100 or recorded on removable memory that was inserted in the device for storage in the contacts database 310, in the appropriate one of the contact data records. Thus the creation of a voice font at steps 320, 322, 324, and 326 is performed remotely at another electronic device, and the storing of the voice font in the contact record at step 328 is performed at the device 100.

Regardless of how the voice fonts are created or received, each of the contact data records can include a voice font based on speech by the individual whose contact information is stored in the contact data record.

As an alternative to entering the address book application 306 by selecting the application from a list of applications, an existing audio file or a voice font stored on the portable electronic device 100 can be selected from within a multimedia application, and an option to create or edit a contact based on said can be invoked to launch the address book application 306.

Figure 9:
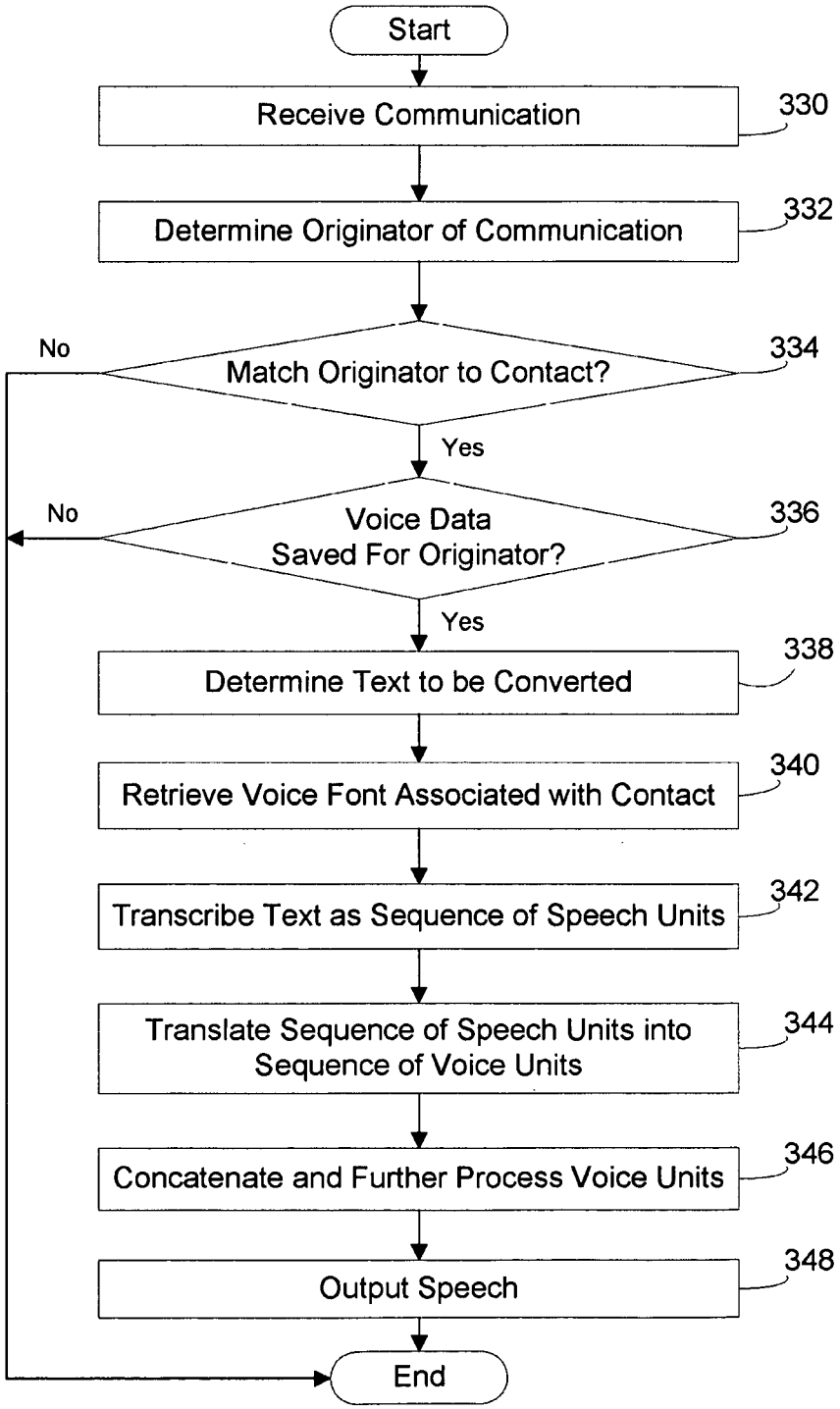
FIG. 9 is a flowchart illustrating steps in a method of text-to-speech conversion at the portable electronic device.

Reference is now made to FIG. 9 to describe steps in the method of text-to-speech conversion at the portable electronic device 100. A communication, such as a telephone call or electronic message in the form of an SMS, email, MMS, or Personal Identification Number (PIN) message, is received at the portable electronic device 100 (step 330). The originator of the communication is then determined by an identifier such as the phone number provided using caller identification in the case of a telephone call or by identifying the phone number for SMS and MMS messages, the email address for email messages, or PIN number for PIN messages (step 332). The identifier of the originator is then compared to the contact data listed in the appropriate category of the contact data records to match the identifier to one of the contacts in the address book (step 334). If no match is found, the process ends. If, on the other hand, a match to one of the contact data records is found, the processor 102 determines if a voice font is stored in the contact data record (step 336). If no voice font is stored in the contact data record, the process ends. If, on the other hand, a voice font is stored in the contact data record, text for conversion to speech is then determined (step 338). The text for conversion to speech can be dependent on a number of factors such as, for example, the communication type and profile settings. The voice font, in the form of the set of voice units for the originator and a mapping of the speech units of the originator's language to the originator's voice units, is then accessed so that voice units can be retrieved from the flash memory 108 as needed (step 340) and the processor 102 begins the text-to-speech conversion. Text-to-speech conversion includes a number of sub-steps, for example, tokenizing, transcription, and prosody. The text is tokenized to parse the text into a series of words based on tokenization rules at the portable electronic device 100; tokenization rules can be based on spaces and punctuation. The words are then transcribed (phonemically or phonetically, as previously described) into sequences of speech units (step 342), which are then translated into sequences of voice units according to speech-unit-to-voice-unit mapping rules in the voice font retrieved from the contact data record in the flash memory 108 (step 344). The sequenced voice units are concatenated to form a complete speech sequence (step 346). Optionally, prosody rules can be then applied for determining pitch, speed, and volume of the voice units according the grammatical context of the voice units. Also optionally, the concatenated voice units can be smoothed so that the juxtaposed voice units sound more natural together. The speech is then played by outputting to the speaker 118 (step 348).

Continued reference is made to FIG. 9 to describe the conversion of text-to-speech by way of example. In the present example, a telephone call is received at the portable electronic device 100 (step 330) and the caller (originator of the call) is determined at the processor 102 by the phone number provided using caller identification (step 332). The telephone number is then compared to the telephone numbers listed in each of the contact data records stored in the contacts database 310. The telephone numbers listed in the contact data records may include, for example, home telephone numbers, mobile telephone numbers, and work telephone numbers. Thus, the telephone number determined using caller identification is compared to each of the telephone numbers in each contact data record to determine if there is a match (step 334). For the purpose of the present example, a match is found to one of the data records stored in the contacts database 310 and it is determined that voice font is stored in the contact data record for which the match was found at step 334 (step 336). In the present example, the voice font stored in the contact data record includes voice units extracted from speech by the caller. Thus, the voice units for the caller are stored in the contact data record associated with the originator of the communication (the caller). The text for conversion into speech for a telephone call is then determined based on profile settings at the portable electronic device (step 338). In the present example, the profile settings are set to announce the caller identification for an incoming telephone call, for example, upon receipt of an incoming call. The text can be, for example, customized to "It's [name] calling, please answer the phone". Thus, if the name of the caller is determined to be David Johnson, the text is "It's David Johnson calling, please answer the phone". Of course any other suitable text can be used and can be added in any suitable manner. For example, text can be loaded on the portable electronic device 100 during manufacturing, prior to purchasing the portable electronic device 100. In another example the text can be loaded after purchasing by downloading or can be added by customizing the profile settings. The voice units are then retrieved from the contact data record associated with the caller (step 340) and the text is converted into speech (steps 342 to 348) as described previously, thereby vocalizing a text notification of the phone call. Thus, the telephone call is announced in the voice of the caller.

Reference is still made to FIG. 9 to describe another example of the conversion of text into speech. In the present example, an electronic message in the form of an email message is received at the portable electronic device 100 (step 330) and the email sender (originator of the email) is determined at the processor 102 by the email address in the "From" field of the email (step 332). The email address is then compared to the email addresses listed in each of the contact data records stored in the contacts database 310. The email addresses listed in the contact data records may include multiple email addresses in a single contact data record as each contact data record may include, for example, a personal email address and business email address as well as any other suitable email address. Thus, the email address is compared to each of the email addresses stored in each contact data record to determine if there is a match (step 334). For the purpose of the present example, a match is found to one of the data records stored in the contacts database 310 and it is determined that speech units are stored in the contact data record for which the match was found at step 334 (step 336). In the present example, the speech units stored in the contact data record includes voice units extracted from speech by the email sender. Thus, the voice units for the email are stored in the contact data record associated with the originator of the communication (the sender). The text for conversion to speech for the email is then determined based on profile settings at the portable electronic device (step 338). In the present example, the profile settings are set to announce receipt of an email. The text can be, for example, customized to "I have sent you an email". Of course any other suitable text can be used and can be added in any suitable manner, as described in the above example. The voice units are then retrieved from the contact data record associated with the sender of the email (step 340) and the text is converted into speech (steps 342 to 348) as described previously. Thus, the receipt of the email is announced in the voice of the email sender.

Reference is made yet again to FIG. 9 to describe yet another example of a method of conversion of text-to-speech. As in the previous example, an electronic message in the form of an email message is received at the portable electronic device 100 (step 330) and the email sender (originator of the email) is determined at the processor 102 by the email address in the "From" field of the email (step 332). The email address is then compared to the email addresses listed in each of the contact data records stored in the contacts database 310. The email addresses listed in the contact data records may include multiple email addresses in a single contact data record as each contact data record may include, for example, a personal email address and business email address as well as any other suitable email address. Thus, the email address is compared to each of the email addresses stored in each contact data record to determine if there is a match (step 334). For the purpose of the present example, a match is found to one of the data records stored in the contacts database 310 and it is determined that a voice font is stored in the contact data record for which the match was found at step 334 (step 336). In the present example, the speech units stored in the contact data record includes voice units extracted from speech by the email sender. Thus, the voice units for the email are stored in the contact data record associated with the originator of the communication (the email sender). The text for conversion to speech for the email is then determined. In the present embodiment, the portable electronic device 100 user may select an option to convert text content of the email into speech. Such an option can be chosen in any suitable manner and at any suitable time. For example, the option can be chosen as a setting prior to receipt of the email message at the portable electronic device 100, at the time of opening the email message, or after opening the email message in an email submenu, for example. For the purpose of the present example, the portable electronic device 100 is set to convert the text of incoming email into speech upon opening the email. Thus, when the user opens the email, the speech units are retrieved from the contact data record associated with the sender of the email (step 340) and the text content of the email is transcribed as a sequence of speech units (step 342). The sequence of speech units is then translated into a sequence of voice units (step 344). The sequenced voice units are concatenated and may be additionally processed (step 346); such additional processing may include smoothing junctures between successive voice units and/or applying prosody rules to determine pitch, speed, and volume of speech units to create more natural-sounding speech. Finally, the speech is played by outputting to the speaker 118 (step 348). Thus, the text content of the email is provided by way of speech in the voice of the email sender. It will be appreciated that in the previous examples, the text is converted into speech automatically upon receipt of the communication. In the final example it is possible that the text content of the email is converted into speech automatically upon receipt. It is also possible, however, that the text content of the email is converted into speech only after user-interaction, such as by removing the portable electronic device 100 from a holster, by opening the email, or by selecting an option to convert text into speech. Thus, many of the steps including, for example, steps 332 to 348 may occur in response to user-interaction to initiate conversion to speech.

Text-to-speech conversion at the electronic device permits a meaningful audible output to be provided rather than a text output. Thus, information normally provided in text format, such as the identity of a caller can be provided audibly. This is particularly useful in cases in which audible output from a speaker is preferred such as when driving a vehicle, for example, or for the visually impaired. Further, the text can be converted into speech simulating the voice of the originator of the communication permitting identification of the originator and reminding the recipient of the sender of the communication. For example, when an email is received, the entire text of the email can be read in the voice of the sender, thereby consistently reminding the user of the sender.

Further, voice units can be stored at the portable electronic device, obviating the need to receive the voice units each time text-to-speech conversion occurs. The voice units can be stored in respective contact data records, thereby associating the voice units with a particular contact. Thus, a plurality of sets of voice units can be stored at the portable electronic device, each set associated with a particular contact. Text resulting from communications received from that contact can be converted into speech using the set of voice units specific to that contact. Further, voice units or data are not transmitted to the portable electronic device each time a communication is received, reducing data transmitted. Further, conversion of text-to-speech at the portable electronic device rather than at a remote device, reduces the data transmitted over-the-air, thereby reducing bandwidth requirements, data transfer time and associated costs In the preceding description, for purposes of explanation, numerous details are set forth in order to provide a thorough understanding of the embodiments of the present application. However, it will be apparent to one skilled in the art that certain specific details are not required. In other instances, features, including functional features, are shown in block diagram form in order not to obscure the description. Further, certain Figures and features are simplified for ease of understanding and explanation. In some cases, for example, specific details are not provided as to whether the embodiments described herein are implemented as a software routine, hardware circuit, firmware, or a combination thereof. Embodiments can be represented as a software product stored in a machine-readable medium (also referred to as a computer-readable medium, a processor-readable medium, or a computer usable medium having a computer-readable program code embodied therein). The machine-readable medium can be any suitable tangible medium, including magnetic, optical, or electrical storage medium including a diskette, compact disk read only memory (CD-ROM), memory device (volatile or non-volatile), or similar storage mechanism. The machine-readable medium can contain various sets of instructions, code sequences, configuration information, or other data, which, when executed, cause a processor to perform steps in a method according to an embodiment. Those of ordinary skill in the art will appreciate that other instructions and operations necessary to implement the described features can also be stored on the machine-readable medium. Software running from the machine-readable medium can interface with circuitry to perform the described tasks.

While the embodiments described herein are directed to particular implementations of the electronic device and method of text-to-speech conversion, it will be understood that modifications and variations to these embodiments are within the scope and sphere of the present application. For example, the above examples refer to telephone calls and email. It will be appreciated that the present application is not limited to these examples as text-to-speech conversion can be carried out as a result of receipt of other types of communication such as other types of messaging.

In a first aspect, there is provided a method of associating a voice font with a contact for text-to-speech conversion at an electronic device includes obtaining, at the electronic device, the voice font for the contact, and storing the voice font in association with a contact data record stored in a contacts database at the electronic device. The contact data record includes contact data for the contact In a further aspect, there is provided an electronic device. The electronic device includes a memory for storage of data, a receiver for receiving communications, a speaker for audio output, and a processor connected to the receiver, the memory and the speaker, for execution of an application for obtaining a voice font for a contact, and associating the voice font with a contact data record stored in a contacts database at the memory.

In a further aspect, there is provided a computer readable medium having computer-readable code embodied therein for execution by a processor at the electronic device for obtaining, at the electronic device, a voice font for a contact, and associating the voice font with a contact data record stored in a contacts database at the electronic device.

The above-described embodiments are intended to be examples only. Alterations, modifications and variations can be effected to the particular embodiments by those of skill in the art without departing from the scope of the present application, which is defined by the claims appended hereto.

What is claimed is:

1. A method of associating a voice font with a contact, for text-to-speech conversion, the voice font comprising voice units corresponding to speech units of a target language, the method comprising:

receiving, at an electronic device, an audio stream, comprising speech from the contact;

segmenting a portion of the audio stream into voice units;

obtaining at least one of each speech unit of the target language;

associating the voice units with corresponding speech units of a target language;

storing the voice font in data record associated with the contact;

receiving a telephone call from the contact;

retrieving the voice font for the contact;

determining text for conversion to speech based on profile settings; and converting the text to speech using the voice font for the contact, wherein the text for conversion to speech is a notification of identity of the contact making the telephone call.

2. The method according to claim 1, wherein storing the voice font in association with a contact data record comprises storing the voice units associated with the speech units as a the voice font in the contact data record.

3. The method according to claim 1, further comprising providing predetermined text for speech by the contact prior to receiving the audio stream comprising speech from the contact.

4. The method according to claim 1, wherein receiving, at the electronic device, an audio stream, comprises receiving, at a microphone at the electronic device, a raw audio stream in the form of speech from the contact.

5. The method according to claim 1, wherein the audio stream comprises a digital audio data.

6. The method according to claim 5, wherein the digital audio data is transmitted in a phone call from the contact.

7. The method according to claim 1, further comprising:

receiving an electronic message at the electronic device;

matching, at the electronic device, an identifier for an originator of the electronic message to an identifier of the contact data record;

determining text for conversion to speech for the electronic message;

retrieving the voice font associated with the contact data record;

converting at the electronic device, the text to speech for the electronic message using the voice font associated with the contact data record; and outputting the speech to a speaker at the electronic device to provide audio voice resembling a voice of the contact.

8. The method according to claim 7, wherein retrieving the voice font associated with the contact data record is carried out in response to receipt of a command to open the electronic message.

9. An electronic device for text-to-speech conversion using a voice font comprising voice units corresponding to speech units of a target language, the device comprising:

a memory for storage of data;

a receiver for receiving communications;

a speaker for audio output;

a processor, coupled to the receiver, the memory and the speaker, for execution of an application for:

receiving an audio stream including speech from a contact, segmenting a portion of the audio stream into voice units;

obtaining at least one of each speech unit of the target language;

associating the voice units with corresponding speech units;

storing the voice font in a data record associated with the contact;

receiving a telephone call from the contact;

retrieving the voice font for the contact;

determining text for conversion to speech based on profile settings; and converting the text to speech using the voice font for the contact, wherein the text for conversion to speech is a notification of identity of the contact making the telephone call.

10. A non-transitory computer readable medium for text-to-speech conversion using a voice font comprising voice units corresponding to speech units of a target language having computer-readable code embodied therein executable by a processor at an electronic device to:

receive, at the electronic device, an audio stream comprising speech from the contact;

segment a portion of the audio stream into voice units;

obtaining at least one of each speech unit of the target language;

associate the voice units with corresponding speech units;

store the voice font in a contact data record associated with the contact;

receiving a telephone call from the contact;

retrieving the voice font for the contact;

determining text for conversion to speech based on profile settings; and converting the text to speech using the voice font for the contact, wherein the text for conversion to speech is a notification of identity of the contact making the telephone call.

* * * * *

UNITED STATES PATENT AND TRADEMARK OFFICE

CERTIFICATE OF CORRECTION

PATENT NO. : 8,645,140 B2
APPLICATION NO. : 12/392357
DATED : February 4, 2014
INVENTOR(S) : Lobzakov It is certified that error appears in the above-identified patent and that said Letters Patent is hereby corrected as shown below:

In the Claims

Column 23, Lines 35-36, Claim 2, delete “a the” and insert -- the --, therefor.

Signed and Sealed this
Tenth Day of June, 2014

Michelle K. Lee

Michelle K. Lee
*Deputy Director of the United States Patent and Trademark Office*